United States Patent [19]

Dahlberg

[11] 4,295,311

[45] Oct. 20, 1981

[54] EXPANSION JOINT ELEMENT

[75] Inventor: Anders Dahlberg, Täby, Sweden

[73] Assignee: Tätis Plasttätningar AB, Täby, Sweden

[21] Appl. No.: 98,047

[22] Filed: Nov. 28, 1979

[30] Foreign Application Priority Data

Dec. 1, 1978 [SE] Sweden ..... 7812402

[51] Int. Cl.[3] ..... E01C 11/04; E04B 1/68

[52] U.S. Cl. ..... 52/396; 404/69

[58] Field of Search ..... 52/396, 404, 403, 309.5, 52/309.12, 309.7; 404/66–69, 47

[56] References Cited

U.S. PATENT DOCUMENTS

| | | | |
|---|---|---|---|
| 3,680,270 | 8/1972 | De Munck | 52/396 X |
| 4,030,852 | 6/1977 | Hein | 404/66 |
| 4,111,583 | 9/1978 | Brady et al. | 52/396 X |

FOREIGN PATENT DOCUMENTS

| | | | |
|---|---|---|---|
| 2243088 | 3/1974 | Fed. Rep. of Germany | 52/396 |
| 6401517 | 8/1964 | Netherlands | 52/396 |

*Primary Examiner*—J. Karl Bell

[57] ABSTRACT

A prefabricated expansion joint element for forming a surface joint between two concrete construction parts (1,2). The joint element has a central, resilient member (4) and anchoring members (5,6) connected to each side thereof. According to the invention the anchoring members are formed by profile elements (5,6) of epoxy plastic with at least one reinforcing layer (7) cast thereinto, said layer also extending through the intermediate resilient member. The external surface of the central resilient member (4) is connected to and aligned with the external surface of the profile elements (5,6). The profile elements (5,6) are securably by adhesion directly onto the edge portions of the concrete construction parts (1,2), so as to provide easy mounting, long life and resistance to severe climatic conditions and heavy loads.

6 Claims, 1 Drawing Figure

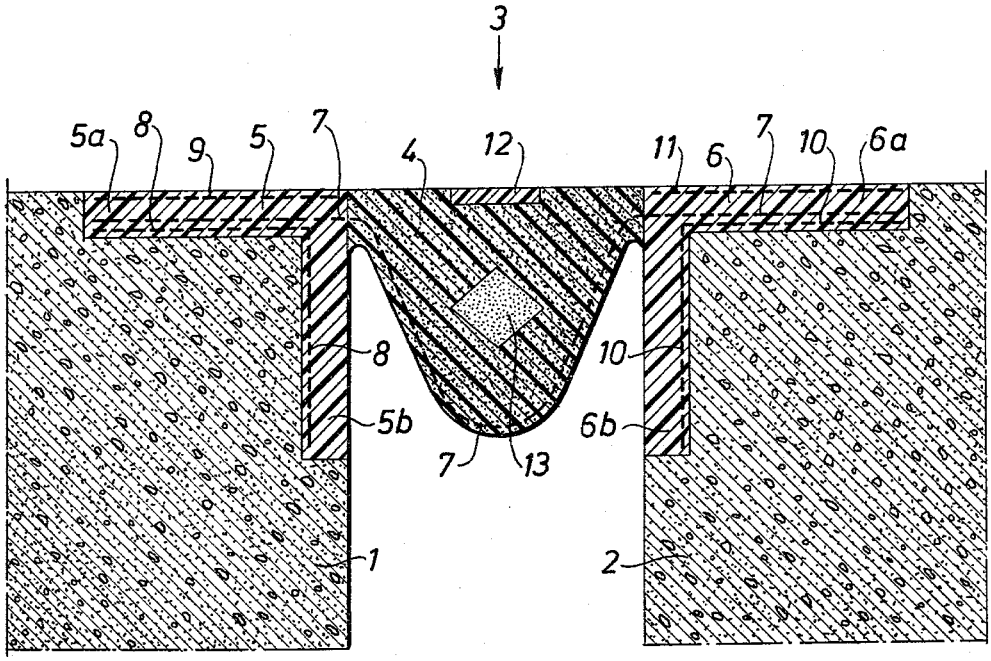
3
5a
8
9
5
7
4
12
11
6
7
10
6a
8
10
5b
6b
7
13
1
2

EXPANSION JOINT ELEMENT

The present invention relates to a bridging device or an expansion joint element for forming a substantially continuous surface joint between concrete construction sections, e.g. in bridges, parking buildings, or other concrete constructions, being subjected to seasonal and/or daily variations in temperature and dilatation movements caused thereby, which necessitate a variable gap between the construction sections.

In bridges and parking buildings, for example, iron reinforcement elements are normally cast into the edge portions and secured to the joints by means of anchoring members located at intervals therealong. Gliding plates cover the gap and an elastic sealing compound is introduced therein. However, such bridging devices have several drawbacks, i.e. high installment costs, sensitivity to penetrating dirt, salt and the like, a relatively short life and expensive repairs.

Furthermore, such expansion joints are known (see e.g. the Swedish Patent Specification Nos. 7104909-2 and 7313932-1), which are not provided with a gliding plate covering the gap but only with a central, resilient member connected at each side to reinforced side elements being anchored to each one of the concrete constructions sections. Also in this case, the joint element is fastened at discrete points, namely by means of specific fasteners such as bolts or the like. These fasteners, however, involve a problem, when initially mounting them as well as during operation, in that stress concentrations appear and ruptures can occur in the material adjacent the fasteners. Thus, even this kind of joint element often requires repairs which are extremely expensive.

The invention as claimed solves the problems related to the prior art joint elements in that it provides an expansion joint element, which in its entirety can be pre-fabricated and has a long life even when subjected to severe climatic conditions and heavy loads and which is simple to mount in original installations as well as when reparing damaged joints. Furthermore, the thermal expansion and conductivity of the inventive joint element are similar to those of concrete. Therefore, there are no problems caused by extreme variations in temperature, such as stress concentrations and ruptures in the adjoining concrete material.

The invention will be described further below with reference to the attached drawing, which schematically shows a cross section through an expansion joint element mounted between two construction sections.

The drawing illustrates the upper edge portions of two adjacent concrete construction parts 1,2 being connected to each other by means of a pre-fabricated expansion joint element 3 formed in accordance with the invention. This expansion joint element comprises a central resilient member 4 and L-shaped side profile elements 5 and 6, respectively, connected at each side thereof. The latter are formed by quite smooth profiles of epoxy plastic being secured to each concrete edge portion by means of an epoxy adhesive having a very good adhesion (which is stronger than the tensile strength of the concrete material itself). Hereby, the joint becomes very strong and the stresses are distributed to the greatest possible extent along the external edge portions of the concrete construction parts so as to substantially reduce the stress concentrations and the risk of breakage in comparison with previously known devices having discrete fasteners.

The corner edges (the connection between the legs 5*a*, 5*b* and 6*a*,6*b* respectively) of the L-shaped profiles 5,6 of epoxy plastic are connected to the intermediate resilient member 4, which essentially consists of a homogenous mixture of epoxy and urethan materials and has a cross-section, which is substantially triangular or considerably thicker at its central portion. The upper surface of member 4 is connected to and is substantially aligned with the profile legs 5*a*,6*a* so that the joint surface is substantially smooth and planar.

The material of the resilient member 4 as well as its geometrical design permit a considerable compression and expansion of the joint. In order to strengthen the joint, however, a reinforcement strip 7 of woven material, e.g. polyester (TERYLENE), is cast into the material so as to extend in one piece through the profile leg 5*a* via the bottom part of the resilient member 4 and through the opposite profile leg 6*a*. This reinforcement strip will take up tensile forces when the joint is expanded to the extent that the cross section of the resilient member assumes a stretched out, centrally substantially thinner form, and also when the resilient member is loaded from above. Reinforcing strips 8–11 of woven material are also cast separately into the different profile legs 5*a*,5*b* and 6*a*,6*b*, respectively, as illustrated in the drawing figure with dotted lines.

In order to keep the upper surface of the resilient member 4 as smooth and planar as possible, an upper, central strip 12 of epoxy plastic is cast into the material in alignment with the profile legs 5*a*,6*b* and a soft core 13, purely made of urethan material, is cast into the material centrally under the strip 12. This soft core 13 permits the surrounding, somewhat stiffer elastic material to compress against the core 13 during the expansion and compression of the joint, so as to heavily deform the core. Hereby, substantially larger expansion and compression movements are made possible, than without such a soft core.

Preferably, the core 13 has a square or rhombic cross sectional form and is oriented obliquely, as shown in the drawing.

The joint element consisting of the profile elements 5,6 and the resilient member 4 can be pre-fabricated in desired lengths, e.g. 1 to 10 m, and can easily be fastened (by adhesion) to the two concrete construction parts to be joined. Furthermore, damage caused by corrosion, penetrating dirt, salt etc. are eliminated and, additionally, the joint surface can be made smoother than on conventional joints.

If required for an increased wear resistance of the joint surface, the upper, central strip 12 of epoxy plastic can be made wider than the one shown in the drawing, so that somewhat narrower side gaps (between the strip 12 and each profile leg 5*a*,6*a*, respectively) are achieved. The surface of the resilient member 4, at these gaps, can furthermore be disposed somewhat below the upper surfaces of the legs 5*a*,6*a* and the strip 12, in order to reduce the wear of the softer and less wear-resistant material (the mixture of epoxy and urethan material), e.g. under the influence of tire studs.

I claim:

1. A pre-fabricated expansion joint element for forming an elongated surface joint between two concrete construction parts, comprising an intermediate resilient member, substantially consisting of an elastic material, and side elements adjoining at each side thereto, and respectively adapted to be secured to one of the concrete construction parts, said side elements being constituted by profile elements of an epoxy plastic having reinforcing means, said profile elements being securable by adhesion directly onto the edge portions of the concrete construction parts, the intermediate resilient member having a thickened central portiion, at least one of said reinforcing means being integrally cast into both of the profile elements as well as into the intermediate resilient member, and the external surface of the intermediate resilient member being connected to and substantially in alignment with the external surfaces of the profile elements.

2. A pre-fabricated expansion joint element as claimed in claim 1, wherein each of the profile elements is substantially L-shaped.

3. A pre-fabricated expansion joint element as claimed in claim 1, wherein the resilient member has an approximately symmetrical triangular cross section with the base of the triangle located at the top.

4. A pre-fabricated expansion joint element as claimed in anyone of claims 1–3, wherein the resilient member consists of a mixture of epoxy and urethan materials.

5. A pre-fabricated expansion joint element as claimed in claim 4, wherein said resilient member has a cast central core of a softer material than the remainder of the resilient member, substantially consisting of pure urethan.

6. A pre-fabricated expansion joint element as claimed in claim 5, wherein a rigid strip of epoxy plastic is cast onto the central portion of the top side of the resilient member, substantially in alignment with the upper legs of the profile elements of epoxy plastic.

* * * * *